US012660949B2

(12) United States Patent
Moss

(10) Patent No.: US 12,660,949 B2
(45) Date of Patent: Jun. 23, 2026

(54) RUGGED MERCHANDISE DISPLAY SHELVING STAND WITH WATER RESISTANT BASE

(71) Applicant: Geoffrey Alan Moss, Maple (CA)

(72) Inventor: Geoffrey Alan Moss, Maple (CA)

( * ) Notice: Subject to any disclaimer, the term of this patent is extended or adjusted under 35 U.S.C. 154(b) by 0 days.

(21) Appl. No.: 18/971,279

(22) Filed: Dec. 6, 2024

(65) Prior Publication Data

US 2026/0157544 A1 Jun. 11, 2026

(51) Int. Cl.
*A47F 5/11* (2006.01)

(52) U.S. Cl.
CPC ..... *A47F 5/114* (2013.01); *A47F 5/116* (2013.01)

(58) Field of Classification Search
CPC .. A47F 5/114; A47F 5/116; A47F 5/11; A47B 96/021; A47B 43/00; A47B 55/06; A47B 47/06
See application file for complete search history.

(56) References Cited

U.S. PATENT DOCUMENTS 2,150,743 A * 3/1939 Mancuso ..... G09F 5/00 229/108.1
6,848,371 B2 * 2/2005 Zheng ..... A47B 43/02 108/165
8,157,112 B2 * 4/2012 Bojie ..... A47F 5/11 211/72
8,485,370 B2 * 7/2013 Dewhurst ..... A47F 5/0018 211/149
9,844,282 B2 * 12/2017 Smith ..... A47B 43/02
9,907,414 B2 * 3/2018 Heuer ..... A47B 96/021
10,448,758 B1 * 10/2019 Abel ..... A47B 43/02
10,524,588 B2 * 1/2020 Pratsch ..... A47B 43/02
10,568,422 B2 * 2/2020 Gibbons, Jr. ..... A47F 5/116
10,568,439 B2 * 2/2020 Bersamin ..... A47F 5/116
11,154,145 B1 * 10/2021 Pfeifer ..... A47F 5/116
11,478,076 B2 * 10/2022 Gibbons, Jr. ..... A47B 43/02
11,576,504 B1 * 2/2023 McMillan-Sweat .... A47F 5/116
11,751,701 B2 * 9/2023 Shaffer ..... A47B 55/06 211/135
2010/0006529 A1 * 1/2010 Groff ..... A47F 5/116 211/186
2017/0079449 A1 * 3/2017 Smith ..... A47B 43/02

* cited by examiner

*Primary Examiner* — Ko H Chan
(74) *Attorney, Agent, or Firm* — David W. Wong

(57) ABSTRACT

A rugged merchandise display shelving stand having a water resistant closed base is provided with a vertical reinforcing panel located between its front panel and rear panel of the stand and secured to the side panels of the stand. A plurality of display shelves comprising a rear shelf portion formed by a foldable panel in the reinforcing panel, which is foldable to engage a mounting slot in the rear panel of the stand to form a horizontal rear display shelf, and a foldable panel in the front panel, which is foldable rearward to engage a mounting tab at its rear edge with a horizontal mounting slot at the front edge of the rear display shelve to form a horizontal front display shelf aligned with the rear display shelf.

9 Claims, 16 Drawing Sheets

RUGGED MERCHANDISE DISPLAY SHELVING STAND WITH WATER RESISTANT BASE

BACKGROUND OF THE INVENTION

1. Field of the Invention

The present invention relates a rugged merchandise display shelving stand having a reinforcing panel located between its front and rear panels. The reinforcing panel enhances the structure of the stand such that the shelves are suitable for supporting merchandise such as packages of beverages having a heavy weight, and the stand also has a water-resistant base.

BACKGROUND ART

A merchandise display stand may be fabricated with hard paper board or corrugated paper board material. The design for ultimately forming the display stand is provided by a design figure printed on a single sheet of paper board to form a design figure having a plurality of foldable panels which may be subsequently erected by folding along fold lines to form the erected display stand. The stand may be folded to a collapsed condition for convenient storage and transportation and it can be erected at the merchandise display site by unfolding and/or folding various additional panels of the design figure.

U.S. Pat. No. 5,826,732 issued to Linda Ragsdale on Oct. 27, 1998 shows an exemplary display shelving stand having a plurality of shelves which is fabricated according to the above method.

However, such known shelving display stands are not strong enough in structure for supporting the weight of relatively heavy items of merchandise such as beverages packaged in metal cans, plastics bottles, paper cartons, or glass bottles, and the like.

Furthermore, such display stand has an opened base bottom which is subject to deterioration by the intrusion of water, such as water used in cleaning the floor, at the display site on which the stand is located.

Still furthermore such display stands are time consuming and labor intensive to erect.

SUMMARY OF THE INVENTION

It is the principal object of the present invention to provide a merchandise display shelving stand having a rugged structure capable for supporting and displaying merchandise items such as beverages packaged in metal cans, plastic containers, paper cartons, or glass bottles, and the like, having a heavy weight.

It is another object of the present invention to provide a merchandise display shelving stand having a water resistant base.

It is yet another object of the present invention to provide a merchandise display shelving which has a self-erecting housing.

It is still another object of the present invention to provide a merchandise display shelving stand fabricated from a single design figure on a single sheet of paper cardboard or corrugated board for easy production.

It is still yet another object of the present invention to provide a merchandise display shelving stand which is collapsible to a collapsed flat condition to facilitate its storage and transportation.

BRIEF DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
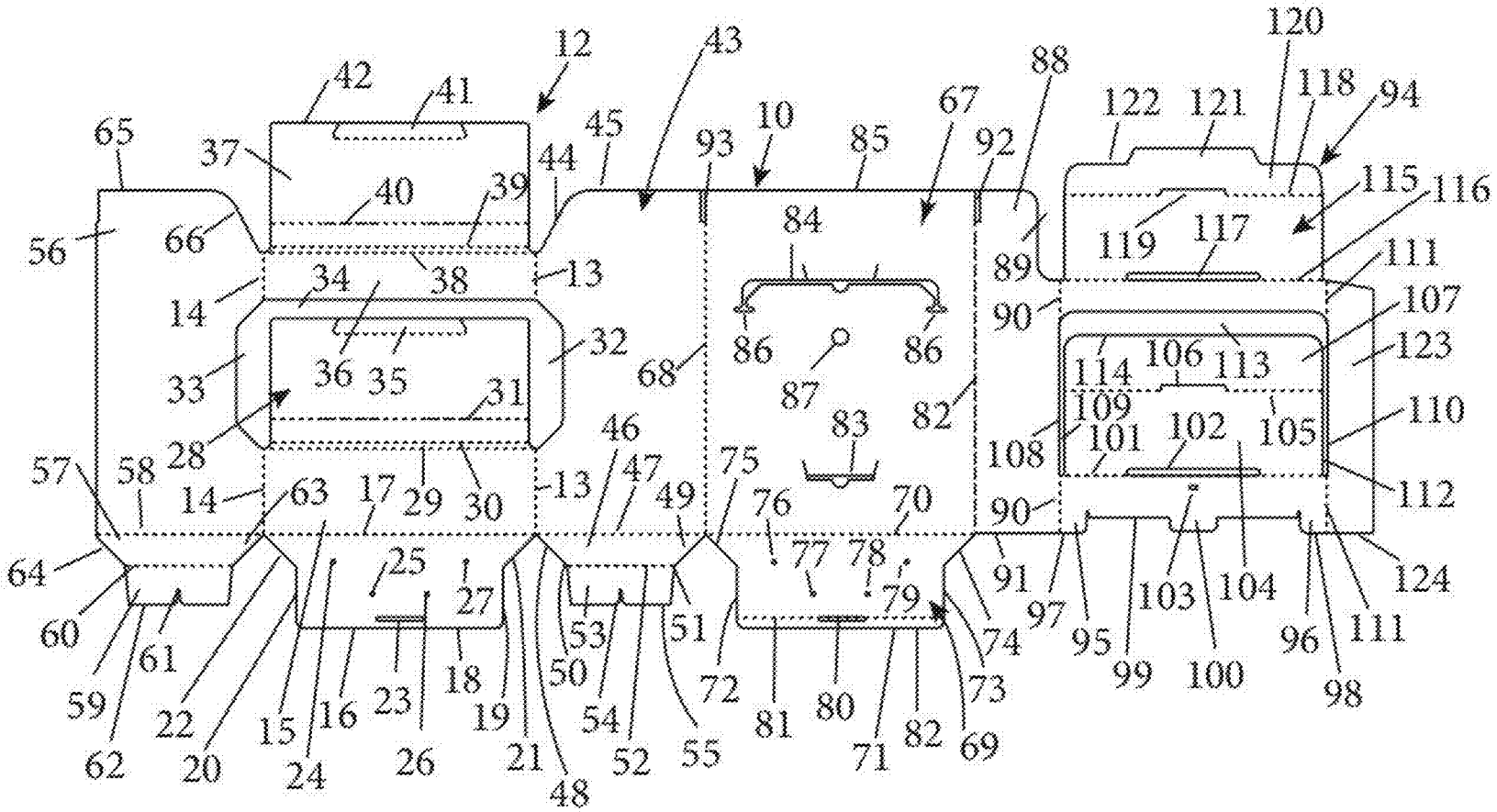
FIG. 1 is a plan elevation view of the single design figure formed on a cardboard having a plurality of panels which are foldable along fold lines for forming the merchandise display shelving stand of the present invention.

With reference to the drawings in which like reference numerals in the various views designate corresponding parts, and for simplicity in description and understanding of the invention, an exemplary embodiment of the display stand shelving having two shelves is described below.

Figure 10:
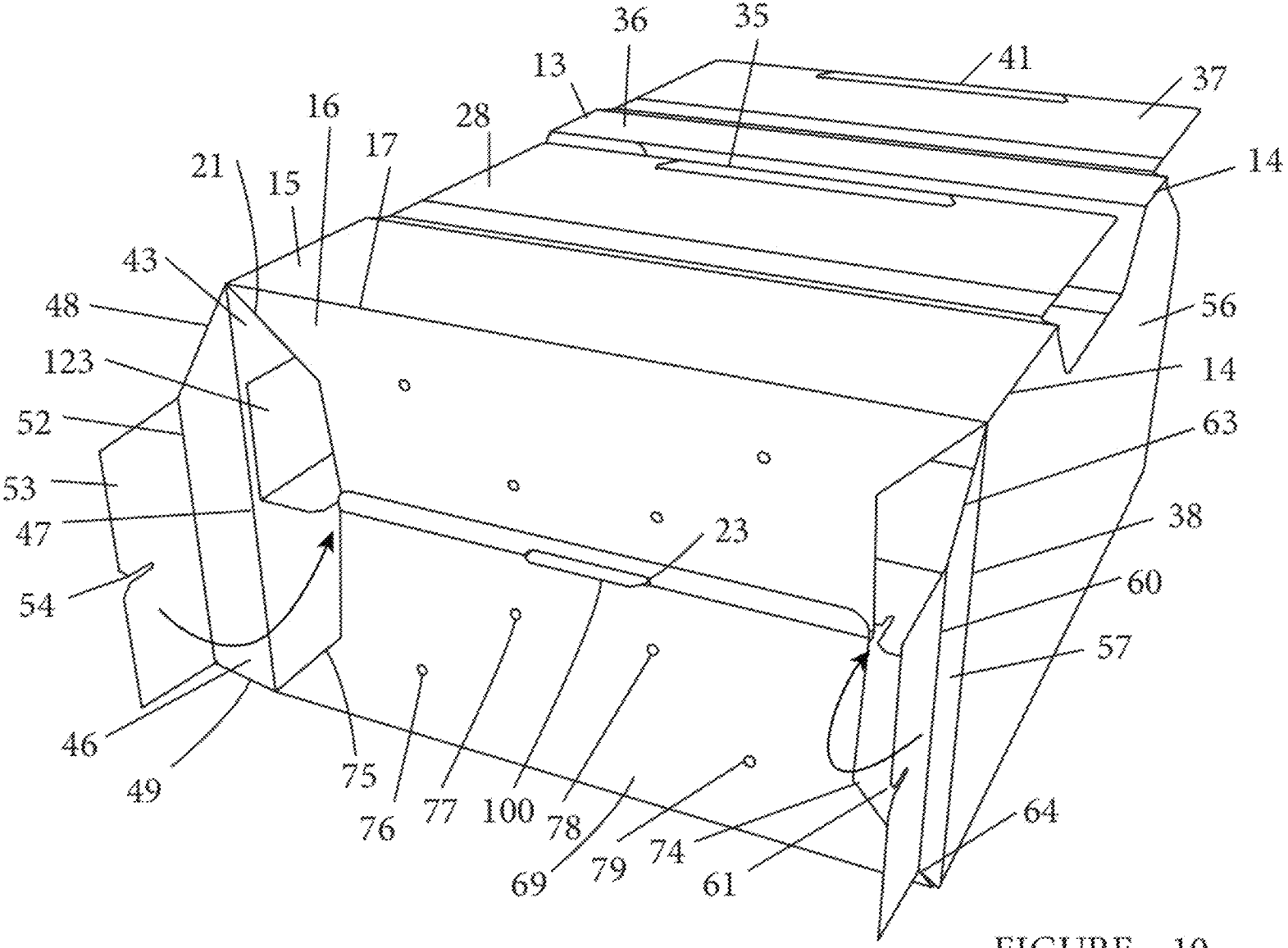
FIG. 10 is a bottom, front and right side perspective view of the housing assembly showing the folding of the bottom extension panels of the left side wall and the right side wall over the remaining openings at the two sides of the base.

As shown in FIG. 1, a design FIG. 10 which can be printed on a single sheet of paperboard such as a hard paperboard or corrugated paper board and then cut out and folded along a plurality of fold lines for fabricating the display shelving stand 11 of the present invention. The design FIG. 10 has a rectangular main panel 12 which would subsequently form the front panel of the stand. The main panel 12 has a right side edge 13 and left side edge 14 which are foldable scored lines. The main panel 12 has a horizontally extending lower rectangular base front panel 15 which would subsequently form the front wall of the base portion of the display shelving stand 11. A bottom foldable panel 16 extends below the lower rectangular base front panel 15 and it connects to the front panel 15 by a foldable base line 17 such that the bottom foldable panel 16 may be folded to dispose at a right angle relative to the lower rectangular base front panel 15. The bottom foldable panel 16 has a lower free edge 18 which is parallel to and shorter in width than the foldable base line 17. The bottom foldable panel 16 has a right vertical side edge 19 and a left vertical side edge 20. A 45 degree angle right side edge 21 extends from the foldable base line 17 to the top end of the right side edge 19 and a 45 degree angle left side edge 22 extends from the foldable base line 17 to the top end of the left side edge 20 of the foldable panel 16. A short horizontal mounting slot 23 is formed adjacent to and spaced from the middle portion of the lower edge 18 of the foldable panel 16. Four mounting openings 24, 25, 26 and 27 are formed in the foldable panel 16. A rectangular foldable lower shelf panel 28 extends above the lower rectangular panel 15. The lower shelf panel 28 and the lower rectangular base front panel 15 are connected by mutually horizontal parallel fold lines 29 and 30. A third horizontal fold line 31 parallel to the fold lines 29 and 30 is formed at a short distance above the fold line 30. The distance between the fold line 30 and the fold line 31 is equal to the height of a shelf front guard to be formed on the display shelf of the display stand. A sideway trapezoidal shape cut-out 32 is formed on the right side of the foldable shelf panel 28 and another sideway trapezoidal shape cut-out 33 which is a mirror image of the cut-out 32 is formed on the left side of the foldable lower shelf panel 28. Also a horizontal rectangular cut-out 34 is formed above the top of the foldable lower shelf panel 28 so that the cut outs 32. 33 and 34 together form an inverted U-shape cut out around the foldable lower shelf panel 28 such that the foldable lower shelf panel 28 is foldable relative to the base front panel 15 to dispose at a right angle relative to the lower rectangular base front panel 15. A horizontal foldable mounting tab 35 is formed at the middle of the upper edge portion of the foldable lower shelf panel 28. A rectangular upper front panel 36 extends above the horizontal cut-out 34. A rectangular upper shelf panel 37, having the same configuration and dimensions as the foldable lower shelf panel 28, extends above the upper front panel 36, and it is connected to the latter with mutually parallel horizontal fold lines 38 and 39. Similar to the lower shelf panel 28 another horizontal fold line 40 parallel to the fold lines 38 and 40 is formed at a short distance from the fold line 39 in which the short distance is equal to the height of the subsequent front guard of the upper shelf of the display stand. The upper shelf panel 37 is foldable to dispose at a right angle relative to the front panel 36. A foldable horizontal mounting tab 41 is formed at the middle portion of the upper edge 42 of the upper shelf panel 37.

A generally C-shape right side panel 43, which will subsequently form the outer left side panel of the display shelving stand of the present invention, is located on the right side of the main panel 12 and it is connected with the main panel 12 by the vertical right side fold line 13. A 45 degree angle upper left side edge portion 44 extends from the fold line 13 to a short upper edge 45 of the rectangular right side panel 43. An inverted trapezoidal shape bottom panel 46 extends below the right side panel 43 and it is connected thereto by a horizontal fold line 47 such that it can be folded to dispose at a 90 degree angle relative to the right side panel 43. The length of the horizontal fold line 47 is equal to the width of the outer side wall of the display shelving stand of the present invention. The trapezoidal shaped panel 46 has 45 degree left and right side edges 48 and 49 respectively which extend downwards to connect to the left and right ends 50 and 51 respectively of the lower edge fold line 52 of the inverted trapezoidal shaped bottom panel 46. A rectangular mounting tab panel 53 extends below the inverted trapezoidal bottom panel 46 and it is connected thereto by the lower edge fold line 52 such that the mounting tab panel 53 is foldable to dispose at a 90 degree angle relative to the inverted trapezoidal bottom panel 46. A vertical slot 54 is formed at the center of the lower edge 55 of the mounting tab panel 53.

A generally rectangular left side panel 56 which is a mirror image of the right side panel 43 both in shape and dimensions, extends at the left side of the main panel 15 and it is connected thereto by the vertical left foldable side edge 14 of the main panel 15. Similar to the right side panel 42, the left side panel 56 has an inverted trapezoidal shape foldable panel 57 which is equal in shape and dimensions to the inverted trapezoidal shape foldable panel 46 of the right panel 43 and it is connected to the left side panel 56 by a lower horizontal foldable line 58. A lower rectangular mounting tab panel 59, equal in shape and dimensions to the lower rectangular mounting tab panel 53 of the right side panel 43, and it is connected to the inverted trapezoidal shape foldable panel 57 by horizontal fold line 60 such that the lower rectangular mounting tab panel 59 is foldable to dispose at 90 degree relative to the inverted trapezoidal shape foldable panel 57. A vertical mounting slot 61 is formed at the center of the lower free edge 62 of the lower rectangular panel 59. A 45 degree edge 63 extends between the vertical left side edge 14 of the main panel 15 to the right end of the horizontal fold line 60, and another 45 degree angle edge 64 extends from the left end of fold line 58 to the left end of the horizontal fold line 60. The left side panel 56 has a horizontal upper edge 65 and a downwardly sloping upper right edge portion 66 extending from the right end of the horizontal upper edge 65 to the upper end of the left side edge 14 of the rectangular main panel 12.

A rectangular panel 67, having the same height as the right side panel 43 and the same width as the main panel 12, extends to the right of the vertical foldable right side edge 68 of the right side panel 43. The rectangular panel 67 will subsequently form the rear wall of the display shelving stand of the present invention. The width and height of the rectangular panel 67 define the width and height of the display shelving stand. A foldable bottom panel 69, having the same shape and dimensions as the bottom foldable panel 16 of the main panel 12, extends downward from a bottom foldable edge 70 of the rectangular panel 67. It has a shorter lower free edge 71. The foldable panel 69 has a left vertical side edge 72 and a right vertical side edge 73. A 45 degree angle upper right side edge 74 extends from the right end of the bottom foldable edge 70 to the top end of the right vertical side edge 73, and another 45 degree angle upper left side edge 75 extends from the left end of the bottom foldable edge 70 to the top end of the left vertical side edge 72. Four mounting openings 76, 77, 78 and 79, similar to the mounting openings 24, 25, 26 and 27 of the foldable panel 16, are formed in the foldable panel 69. Similarly, a horizontal mounting slot 80 is formed at the middle of a horizontal fold line 81 and is spaced above the bottom free edge 82 of the foldable bottom panel 69. The mounting openings 76 and 79 are adjacent to the horizontal fold line 70 while the mounting openings 77 and 78 are adjacent to the horizontal fold line 81. The rectangular panel 67 has a vertical right side edge 81. A lower horizontal mounting slot 82 is formed at the middle of the lower portion of the rectangular panel 67 and it is spaced from the bottom foldable edge 70. The horizontal location of the mounting slot 82 defines the horizontal location of the lower shelf of the display shelving stand of the present invention. An elongated upper horizontal mounting slot 83 which defines the horizontal location of the upper display shelf of the display shelving stand of the present invention, is formed at the upper portion of the rectangular panel 67 and it is spaced from the upper edge 84 of the rectangular panel 67. The upper horizontal mounting slot 83 preferably is provided with inverted T-shaped end portions 85 and 86 as shown in FIG. 1. A circular opening 87 spaced below the upper horizontal mounting slot 83, is formed at the upper central location of the rectangular panel 67 to facilitate the fabrication of the upper display shelf during erection of the display shelving stand.

A generally rectangular connecting panel 88 having a height equal to that of the rectangular panel 67 and a width equal to half of that of the right side panel 43, extends to the right of the vertical right foldable edge 81 of the rectangular panel 67. A generally rectangular cut out 89 may be formed at the upper right hand corner of the connecting panel 88. The connecting panel 88 has a vertical foldable right edge 90 and a bottom free edge 91. A short vertical slot 92 is formed at the upper left hand corner of the connecting panel 87. A similar short vertical slot 93 is also formed at the upper right hand corner of the right side panel 43.

A generally rectangular reinforcing panel 94 extends from the right side of the vertical foldable right edge 90 of the connecting panel 88. The reinforcing panel 94 has two lower corner portions 95 and 96 which have bottom edges 97 and 98 respectively that are aligned with the bottom edge 91 of the connecting panel 88. A bottom edge 99 extends between the lower corner portions 95 and 96 and it is recessed from the bottom edges 97 and 98 of the lower corner portions 95 and 96. A retaining tab 100 is formed at the middle portion of the bottom edge 99. The bottom edge 99 of the retaining tab 100 is also recessed from the bottom edges 97 and 98 of the lower corner portions 95 and 96. A horizontal fold line 101 extending throughout the entire width of the reinforcing panel 94 is formed at a horizontal level aligned with the lower horizontal mounting slot 82 of the rectangular panel 67. An elongated horizontal slot opening 102 is formed at the middle portion of the horizontal fold line 101. A mounting opening 103 is formed below and spaced from the middle of the horizontal fold line 101. A lower rear panel 104 is located above the horizontal fold line 101. A horizontal mounting tab 106 is formed at a middle portion of the horizontal fold line 105. The distance between the horizontal fold lines 101 and 105 is equal to the depth of the lower rear display shelf to be formed in the display shelf stand. A generally rectangular mounting tab portion 107 is located above the horizontal fold line 105. A left vertical cut out 108 is formed between the vertical foldable right edge 90 of the connecting panel 88 and the left side edge 109 of the lower rear panel 104, and a similar right vertical cut out 110 is formed between the right vertical foldable edge 111 of the reinforcing panel 94 and the right vertical side edge 112 of the lower rear panel 104. A narrow horizontal cut out 113 is also formed above the top edge 114 of the lower rear panel 104 such that the lower rear panel 104 is foldable freely along the horizontal fold line 101 with respect to the reinforced panel 94. An upper rear shelf panel 115 is located above the horizontal cut out 113. The shape and dimensions of the upper rear shelf panel 115 are equal to those of the lower rear panel 104. A horizontal fold line 116 extending the entire width of the upper rear shelf panel 115 is formed at a level aligned with the horizontal mounting slot 83 of the rectangular panel 67. A horizontal mounting tab 117 is formed at the middle portion of the horizontal fold line 116. An upper horizontal fold line 118 extending the entire width of the reinforcing panel 94 is formed at a horizontal level aligned with the upper edge 84 of the rectangular panel 67. A horizontal mounting tab 119 is formed at the middle portion of the upper horizontal fold line 118. A rectangular mounting panel 120 is located at the upper free end portion of the reinforced panel 94. A horizontal upper end mounting tab 121 is formed at the middle portion of the upper edge 122 of the rectangular mounting panel 120.

A rectangular vertical securing panel 123 is located on the right side of reinforcing panel 94 and connected thereto by the vertical foldable edge 111. The width of the rectangular vertical securing panel 123 is preferably equal to half of the width of the right side panel 43. The bottom edge 124 of the rectangular vertical securing panel 123 is aligned with the bottom edge 98 of the lower corner portion 96 of the reinforcing panel 94.

Figure 2:
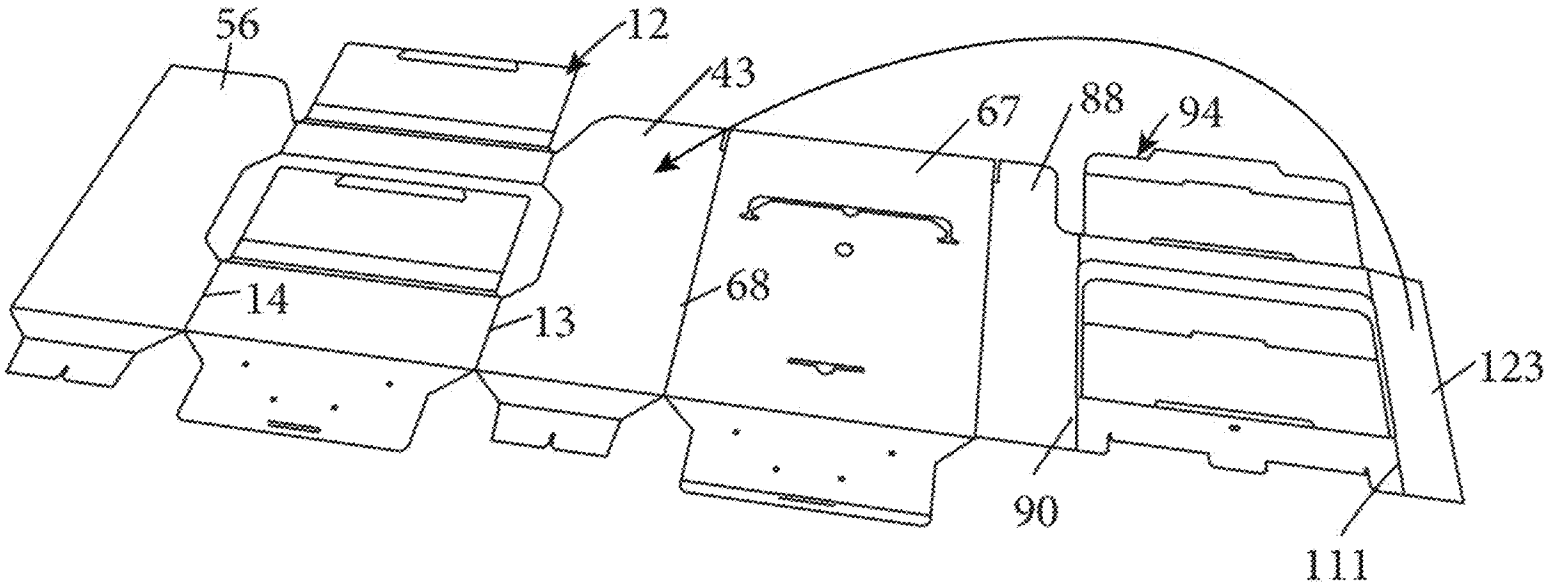
FIG. 2 is a perspective plan elevation view of the design figure showing the first step of folding, placing and securing the side panel of a central reinforcing panel to the left side enclosure panel so that the central reinforcing panel covers over the rear enclosure panel.
Figure 3:
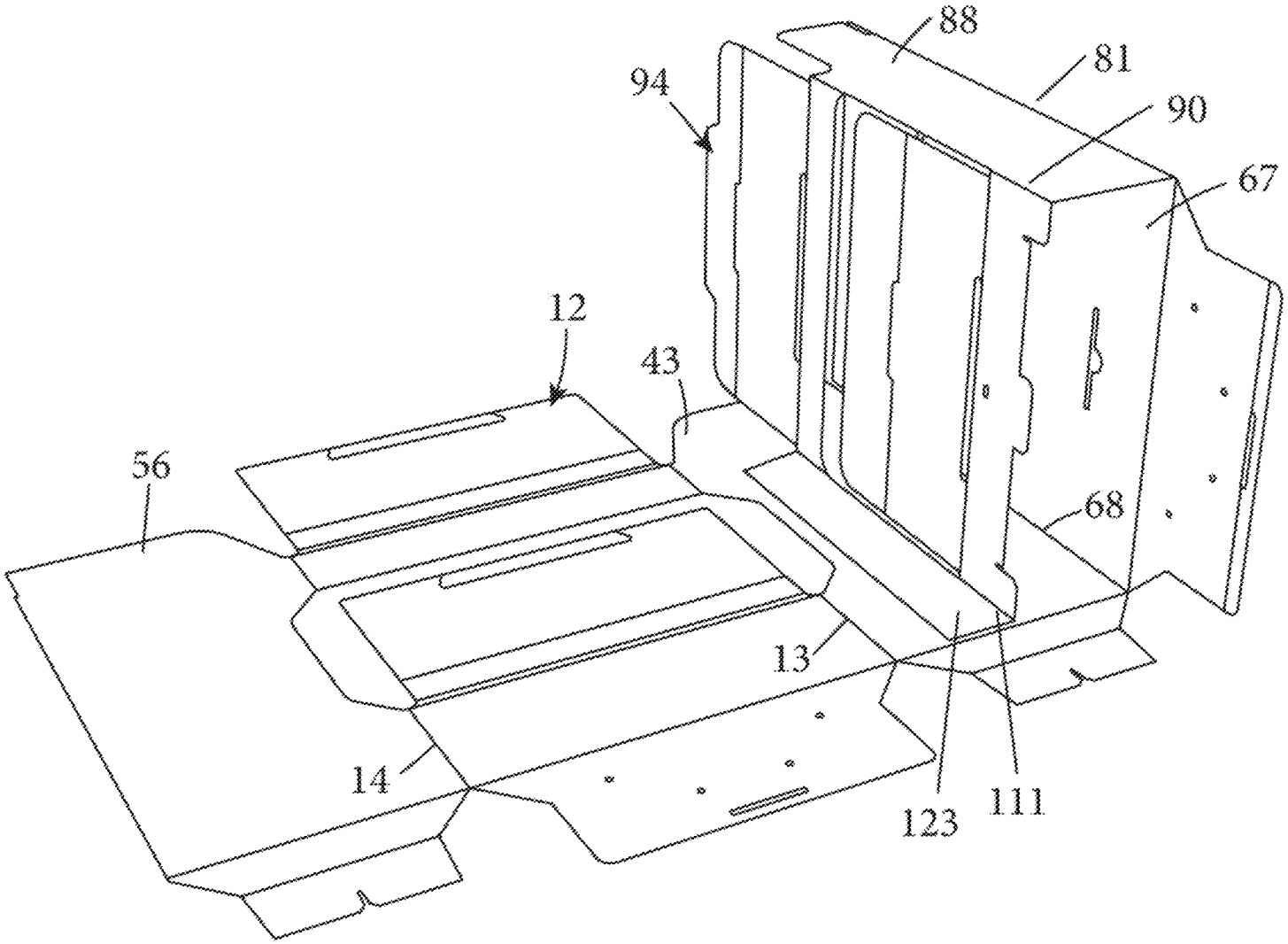
FIG. 3 is a perspective front and bottom perspective view showing the partially folded view in the fabrication of the stand following the second step in folding the first step shown in FIG. 1 for placing and securing the mounting side panel onto the right enclosure side panel.
Figure 4:
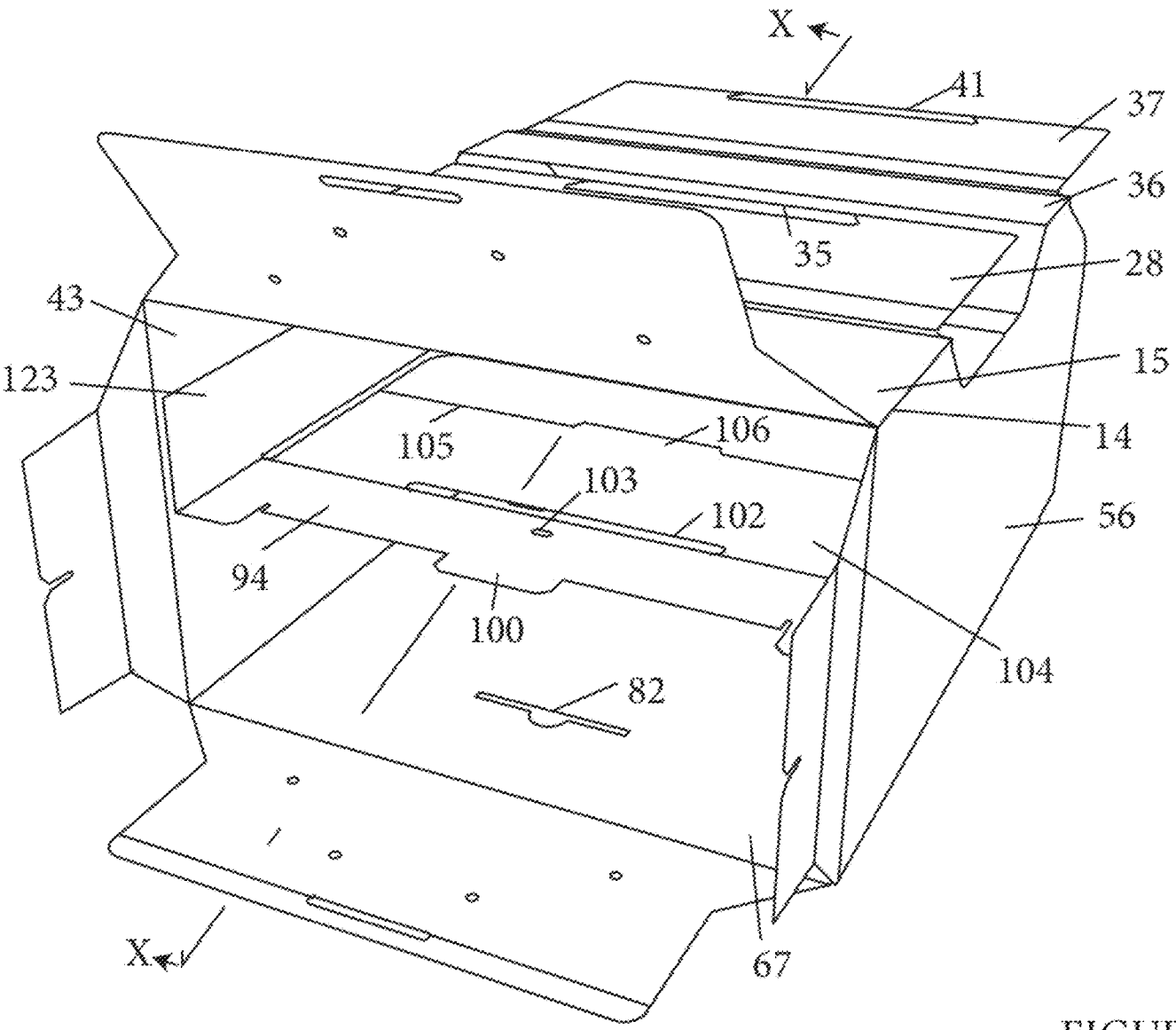
FIG. 4 is the front, right side and bottom perspective view showing the formation of the housing assembly of the display shelving stand.
Figure 5:
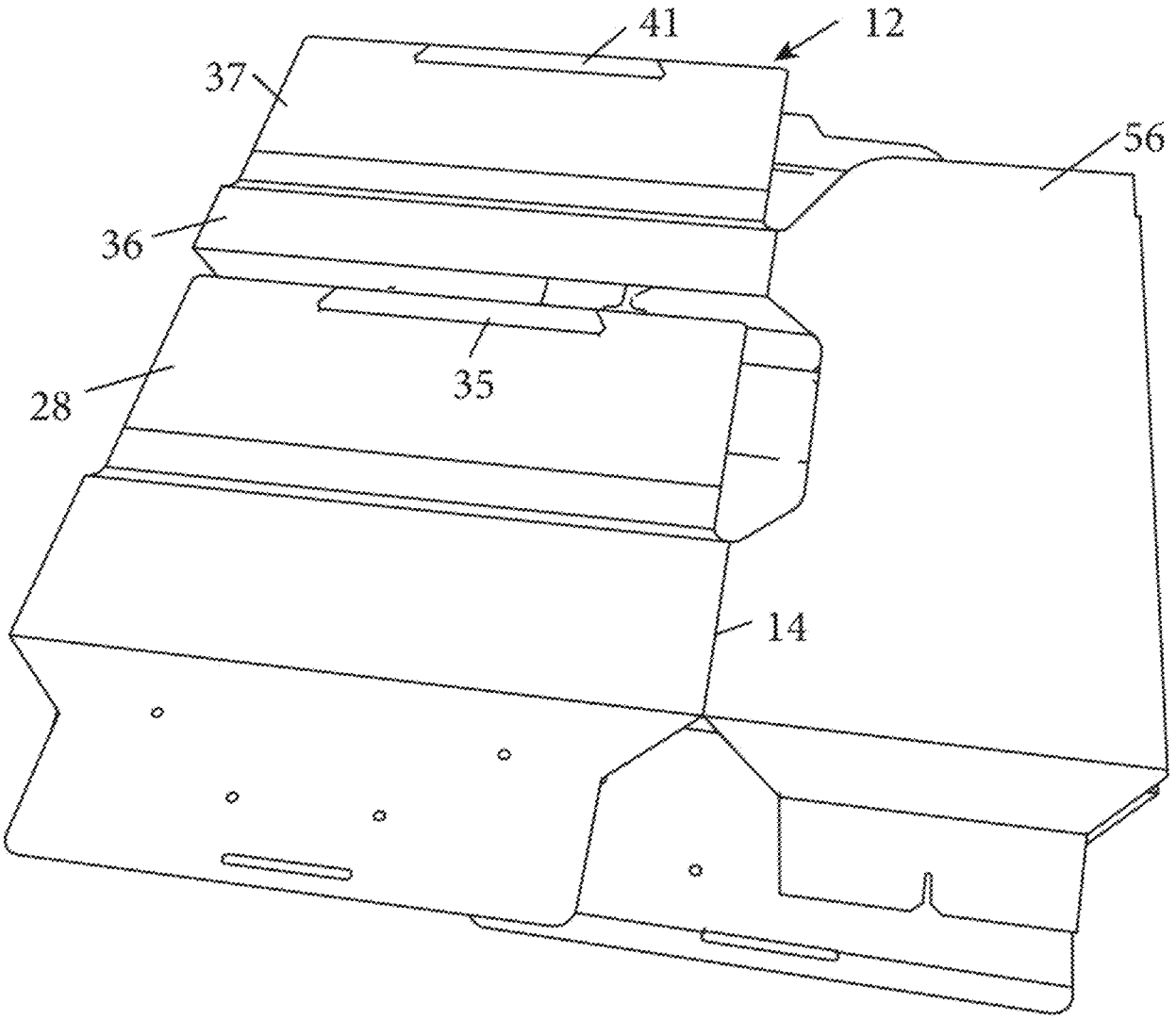
FIG. 5 is a perspective plan view of the housing assembly in a collapse flat condition.

The design FIG. 10 of the display shelving stand can be constructed into a preliminarily prefabricated condition in which the housing has been constructed such that the stand can be readily and quickly erected at the merchandise display site with ease with a few simple procedures to form the completed display shelving stand 11. As best shown in FIG. 2, to construct the prefabricated stand, the reinforcing panel 94 is first folded upward at the left foldable edge 90 towards the rectangular panel 67 with the connecting panel 88 also folded towards the left until the securing panel 123, which is folded relative to the vertical foldable edge 111, is in contact with the right side panel 43 with the foldable edge 111 aligned with the vertical central line of the right side panel 43 as best shown by the arrow in FIG. 2. The bottom edge of the securing panel 123 is also aligned with the bottom edge 47 of the right side panel 43 as best shown in FIG. 3. Thus the reinforcing panel 94 is located halfway between the right side fold line 13 of the main panel 12 and the foldable right side edge 68 of the right side panel 43. The securing panel 123 can then be secured to the right side panel 43 with adhesive. The main panel 12 can then be folded towards the right at the right side fold line 13, with the left side panel 56 also folded upwards and perpendicular to the main panel 12 so that the left side panel 56 lies over the connecting panel 88 with its left side free edge aligned with the right side fold line 81 of the connecting panel 88. The left side panel 56 can then be secured to the connecting panel 87 with adhesive. Thus, the reinforced panel 94 is firmly secured to the left side panel 43 as well as with the connecting panel 88 which has been secured to the left side panel 56. The left side panel 56 now forms the right side wall of the display shelving stand housing, and the right side panel 43 forms the left side wall of the display shelving stand housing. The reinforcing panel 94 is therefore located spaced from the rectangular main panel 12 which subsequently forms the front panel of the display shelving stand housing and the rectangular panel 67 forms the rear wall of the display shelving stand housing as best shown in FIG. 4. The assembly may be pushed sideway on the sidewalls to a collapsed condition as best shown in FIG. 5. The assembly in the collapsed condition may be pushed sideway easily to an erected condition again at the merchandise display site for erecting the display shelving stand.

Figure 6:
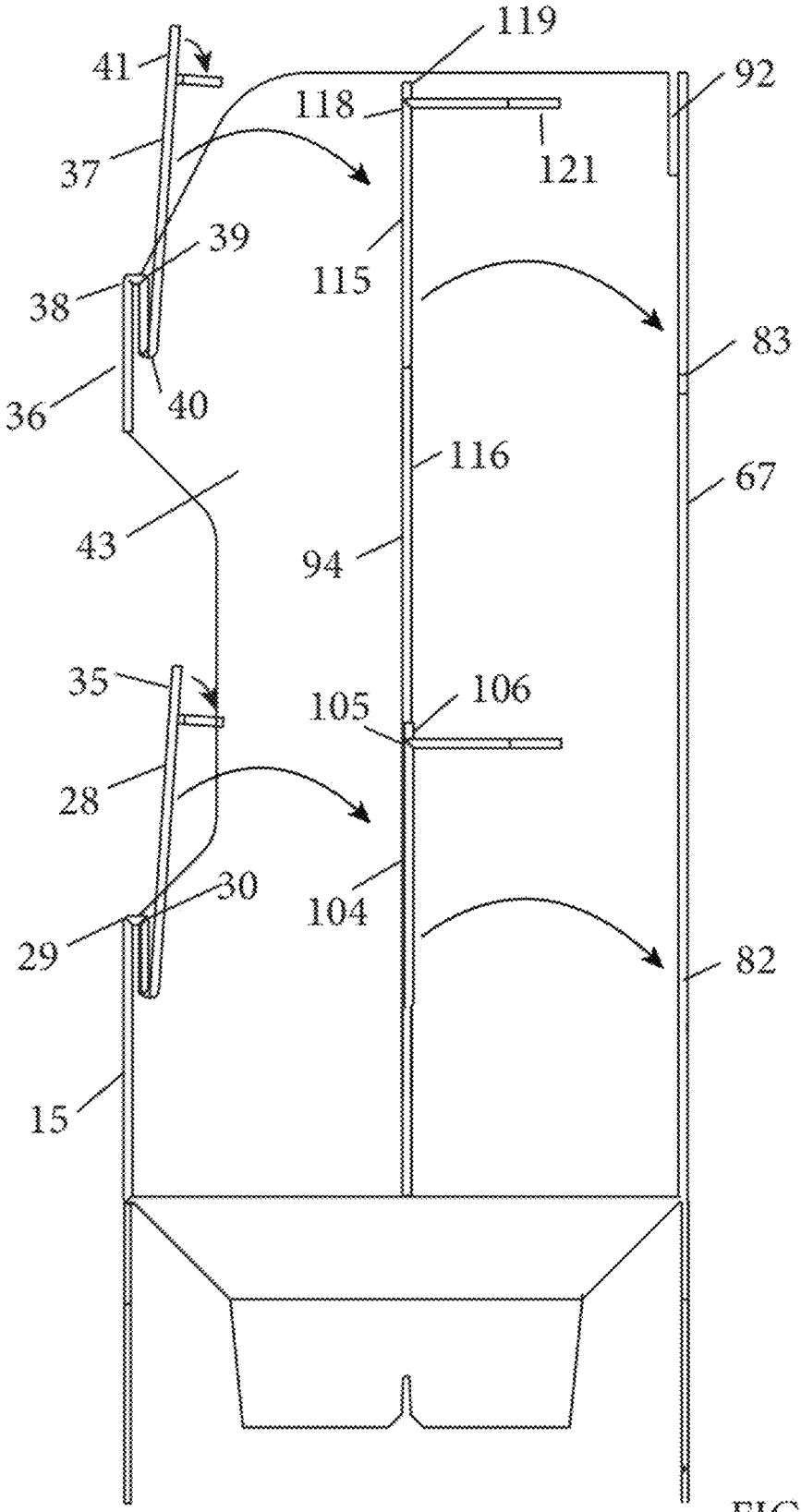
FIG. 6 is an enlarged cross section right side elevation view of the stand along the cross sectional line x-x of the housing assembly shown in FIG. 4 showing the formation of folding of the various panels from the reinforcing panel and the front panel to form the shelves of the display stand.
Figure 7:
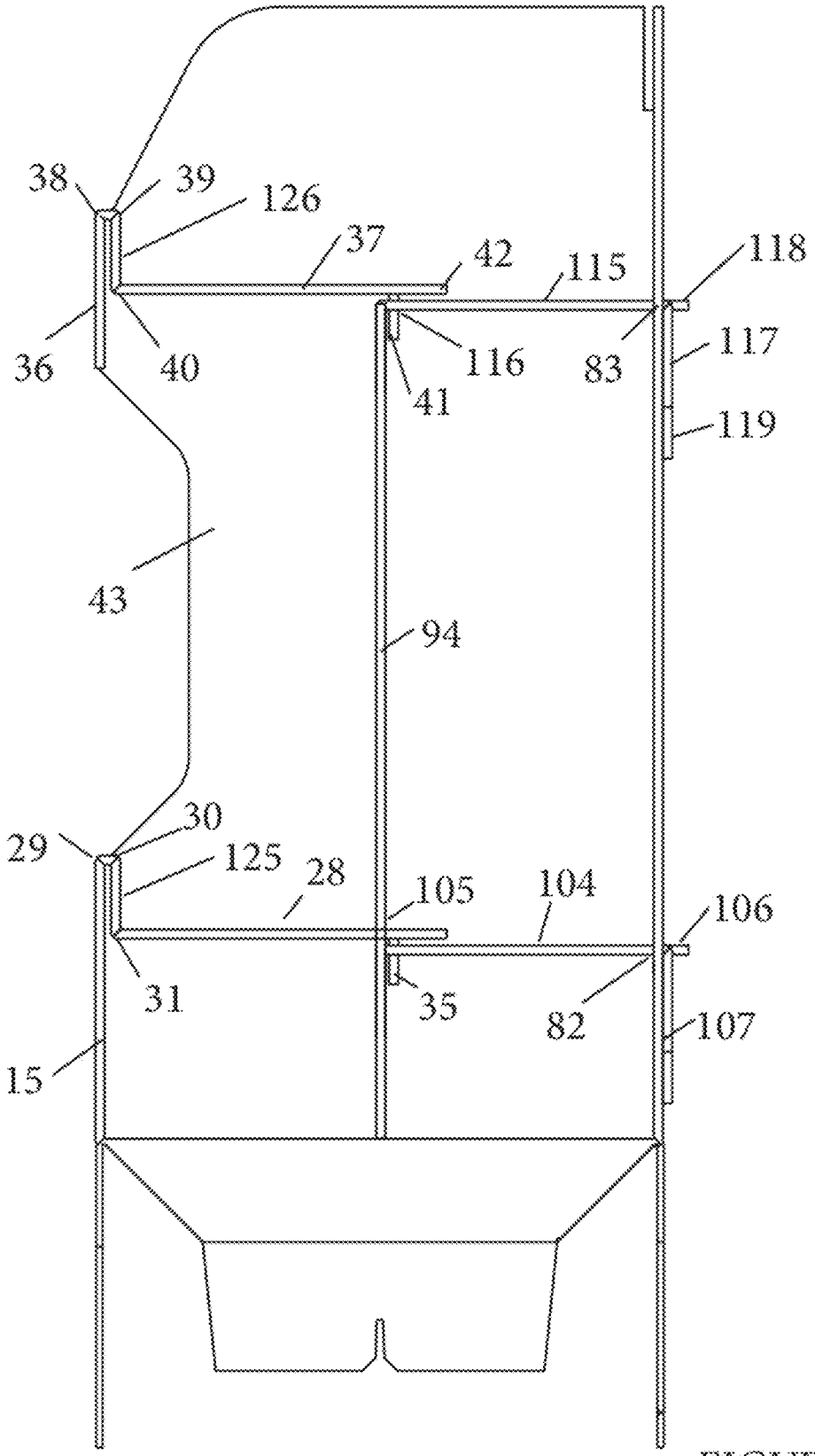
FIG. 7 is a similar cross sectional view of FIG. 6 showing the final formation of the shelves with the various foldable shelf panels from the reinforcing panel mounted to the rear panel, and the various foldable shelf panels from the front panels mounted to the reinforcing panel.

As best shown in FIGS. 6 and 7, with the housing assembly in the erected condition, the lower foldable shelf panel 104 of the reinforcing panel 94 is folded along horizontal fold lines 101 and 105 towards the rectangular panel 67 i.e. the rear wall of the display shelving stand housing until the horizontal mounting tab 106 can be inserted into the horizontal mounting slot 82 of the rear panel to secure the lower foldable shelf panel 104 in the horizontal position forming the horizontal rear portion 104 of the lower display shelf of the display shelving stand of the present invention. The rear portion 104 of the lower display shelf thus is fully supported by the reinforcing panel 94 and the rear panel 67 of the display shelving stand housing. Similarly, the upper rectangular panel 115 may be folded along horizontal fold lines 116 and 118 until the horizontal mounting tab 119 engages with the horizontal mounting slot 83 of the rear wall 67 with the upper portion of the upper rectangular panel 115 extending downwards from the horizontal mounting slot 83 to secure the upper rectangular panel 115 in a horizontal position to form the horizontal rear portion 115 of the upper shelf of the display shelving stand. Thus, the horizontal rear portion 115 of the upper shelf is fully supported between the reinforcing panel 94 and the rear panel 67 of the display stand housing. After the rear portions of the lower and upper display shelving stand have been formed, the lower foldable shelf panel 28 of the main panel 12, i.e. the front panel of the housing can be folded along horizontal fold lines 29, 30, and 31 and pushed rearwards against the reinforced panel 94 until the horizontal foldable tab 35 engages with the horizontal mounting slot 102 of the reinforcing panel 94 with the horizontal mounting slot 102 now exposed at the rear top edge of the horizontal rear portion 104 of the lower display shelf to secure in a horizontal position to form the horizontal front portion 28 of the lower shelf of the display shelving stand, and the front portion 28 of the lower shelf is fully supported between the reinforcing panel 94 and the front panel 12 of the display stand. A double folded lower front guard 125 is also formed at the front of the lower shelf panel 28 by folding along horizontal fold lines 29, 30 and 31. The front guard 125 has a cross sectional inverted U shape and it is perpendicular to the lower shelf panel 28. The front guard 125 not only prevents display merchandise items from sliding off the front of the shelf but also provides additional strength to the shelf to resist bending of the shelf by the weight of the merchandise to provide a rugged weight support of the display merchandise. Similarly, the upper shelf panel 37 is folded along horizontal fold lines 38, 39, and 40 and bended rearwards towards the reinforcing panel 94 until the horizontal mounting tab 41 engages with the horizontal mounting slot 117, which is now formed at the rear edge of the upper rectangular panel 115 of the reinforcing panel 94, to form the front portion 37 of the upper shelf of the display shelving stand. Thus, the front portion 37 of the upper shelf is fully supported between the reinforcing panel 94 and the front panel 12 of the display stand. A doubled folded upper front guard 126 is also formed by the folding along fold lines 38, 39 and 40 to form an upper front guard 126 extending perpendicularly at the front of the upper shelf panel 37. The front guard 126 has a cross sectional inverted U shape and it provides additional strength to the upper shelf 37 to support the weight of the merchandise located thereon as well as preventing the merchandise from sliding off the front of the upper shelf of the display shelving stand.

Figure 8:
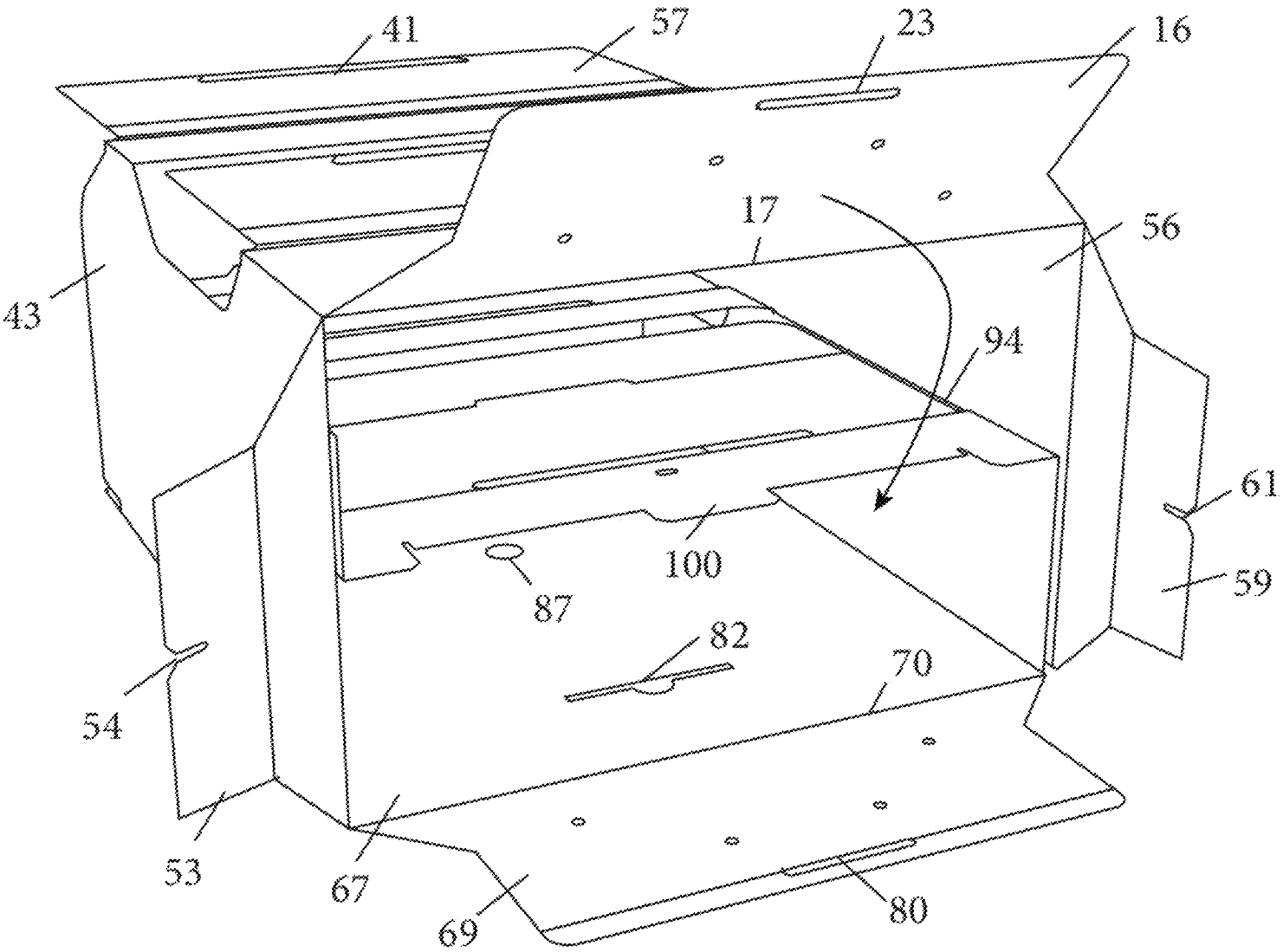
FIG. 8 is a bottom, front and left side perspective view of the housing assembly showing folding of the bottom front extension panel over the front portion of the base for mounting to the mounting tab at the bottom edge of the reinforcing panel.
Figure 9:
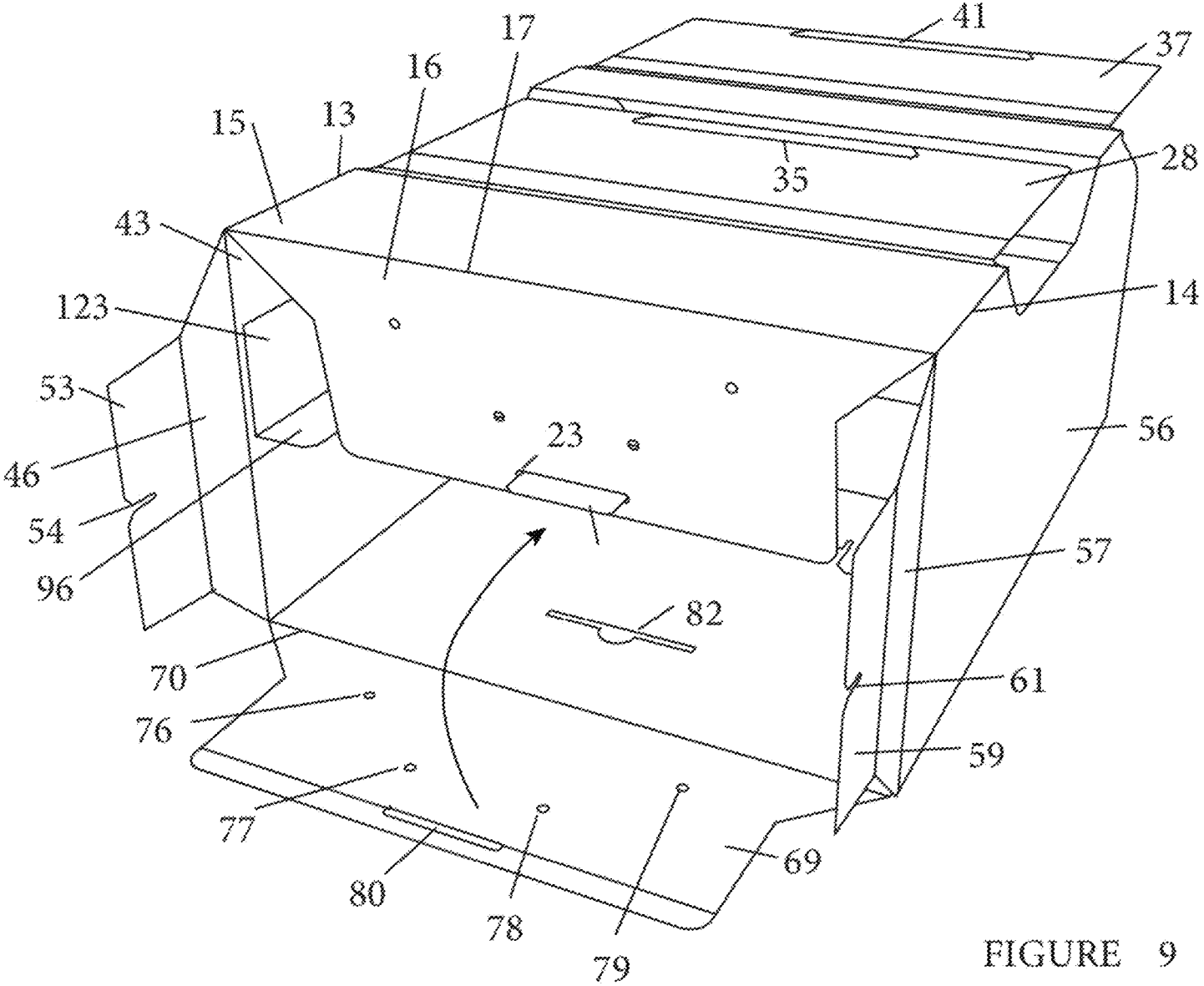
FIG. 9 is a bottom, front, and left side perspective view of the housing assembly showing the folding of the bottom rear extension panel over the rear portion of the base for mounting to the mounting tab of the reinforcing panel.
Figure 11:
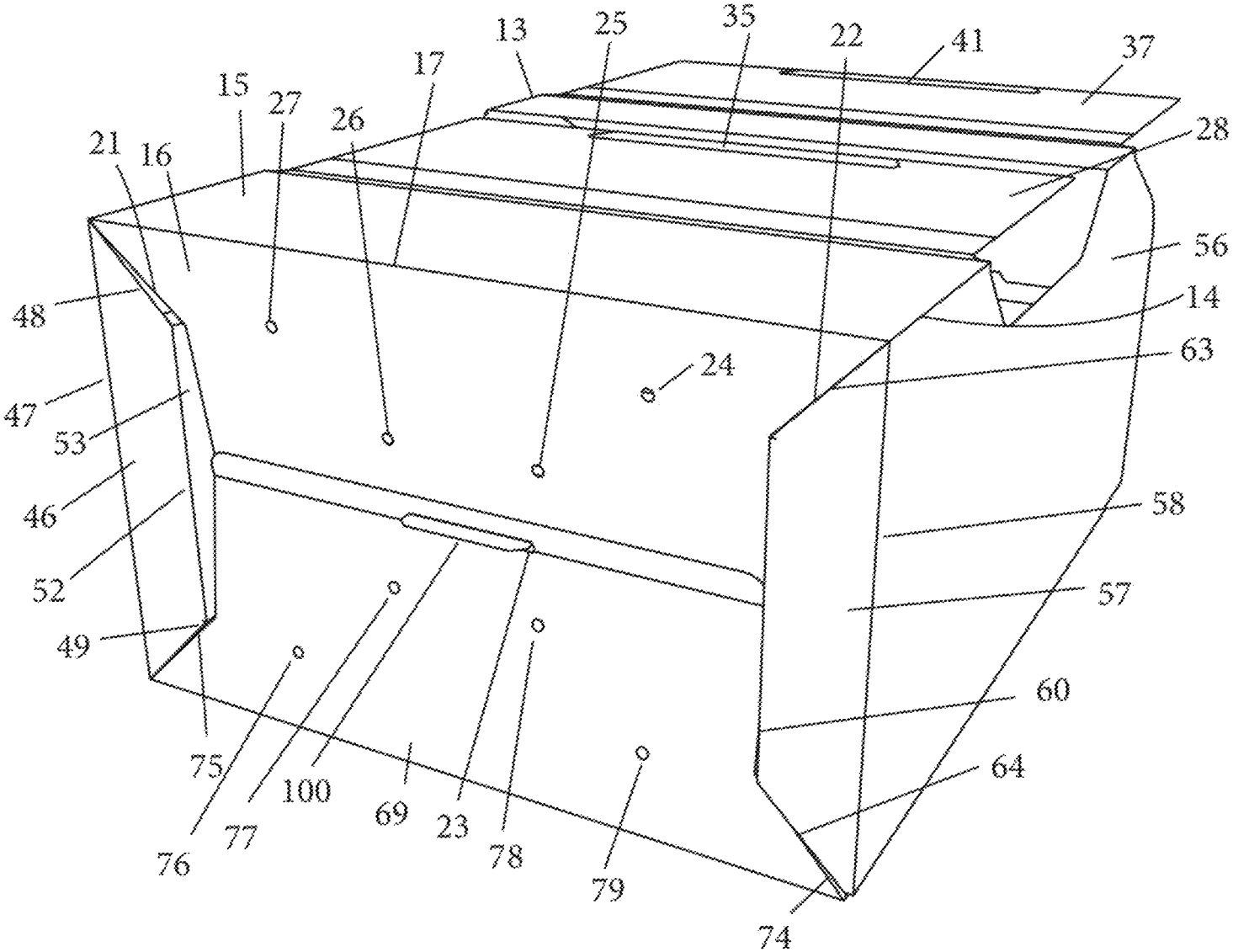
FIG. 11 is a bottom, front and right side perspective view of the fabrication of the stand in the erected condition with the base fully covered by the extension bottom panels of the front wall, rear wall, and the side walls.

The unique base bottom of the display stand may be fabricated by folding the bottom foldable panel 16 of the front main rectangular panel 12 along the horizontal fold line 17 towards the center of the display stand assembly as shown by the arrow in FIG. 8 until the mounting slot 23 of the bottom foldable panel 16 engages with the retaining tab 100 at the bottom of the reinforcing panel 94 to secure the bottom foldable panel 16 covering over the front portion of the bottom of the stand housing assembly. Similarly, the foldable bottom panel 69 of the rear panel 67 of the display stand is also folded along the fold line 70 towards the center of the stand as shown in FIG. 9 until it also engages with the retaining tab 100 of the reinforcing panel 94 to cover over the rear portion of the bottom of the stand housing assembly. Since the retaining tab 100 is recessed from the bottom edge of the housing assembly, the bottom panels 16 and 69 are held in a slanted upward manner in a raised position by the retaining tab 100 of the reinforcing panel 94 such that the bottom panels 16 and 69 are not in contact with the floor on which the display shelving stand is located. After the mounting of the bottom foldable panels 16 and 69, the inverted trapezoidal panel 46 at the bottom of the left side wall of the housing assembly is folded along the fold lines 47 and 52 towards the center of the housing assembly until the inverted trapezoidal panel 46 covers over the remaining trapezoidal shaped opening at the left side of the bottom of the housing assembly with the rectangular mounting tab panel 53 inserted inwards into the base until the mounting slot 54 engages with the bottom edge of the reinforcing panel 94 to retain it in the mounted position covering over the trapezoidal shaped opening. Similarly, the inverted trapezoidal panel 57 at the bottom of the right side wall of the housing assembly is folded along the fold lines 58 and 60 towards the center of the housing assembly until the inverted trapezoidal panel 57 covers over the remaining trapezoidal shaped opening at the right side of the bottom of the housing assembly with the rectangular mounting tab panel 59 inserted inwards until the mounting slot 61 engages with the bottom edge of the reinforcing panel 94 to retain it in the mounted position covering over the trapezoidal shaped opening. The 45 degree angle side edges 48 and 49 of the inverted trapezoidal panel 46 abut the 45 degree angle side edges 74 and 75 respectively of the bottom panels 16 and 69 as well as the 45 degree angle side edges 63 and 64 of the inverted trapezoidal panel 57 abut the 45 degree angle side edges 22 and 14 respectively of the bottom panels 16 and 69 as shown by the arrows in FIG. 10 to fully cover the entire bottom of the housing assembly as shown in FIG. 11 such that water is prevented from entering the bottom of the display shelving stand to cause deterioration when the erected stand is placed over a floor, thus forming a water resistant base . . .

Figure 12:
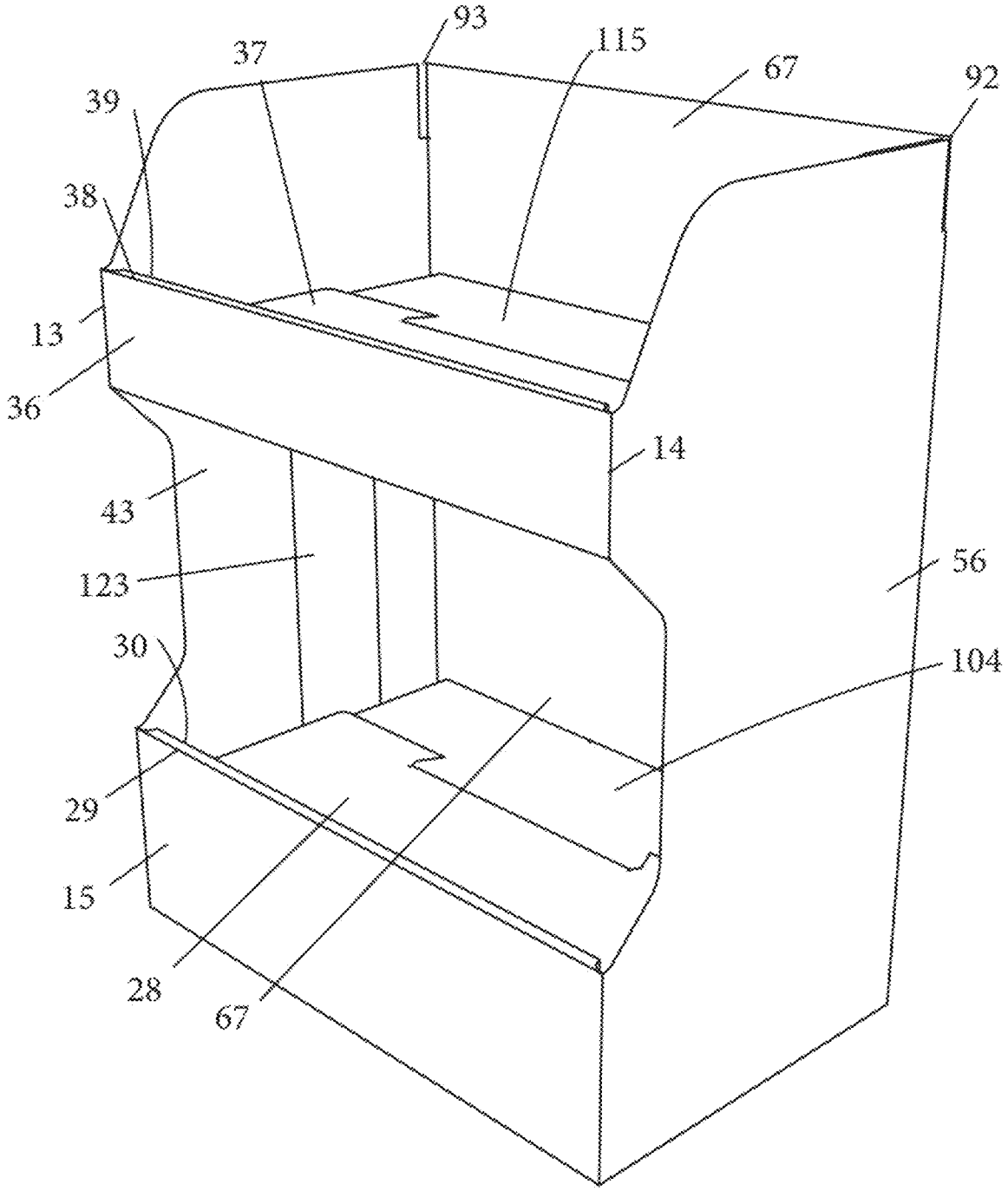
FIG. 12 is a perspective top and right view of the display shelving stand in the fully erected condition.

The exemplary display stand with two display shelves in the fully erected condition following the fabrication procedure as described above is shown in FIG. 12.

Figure 13:
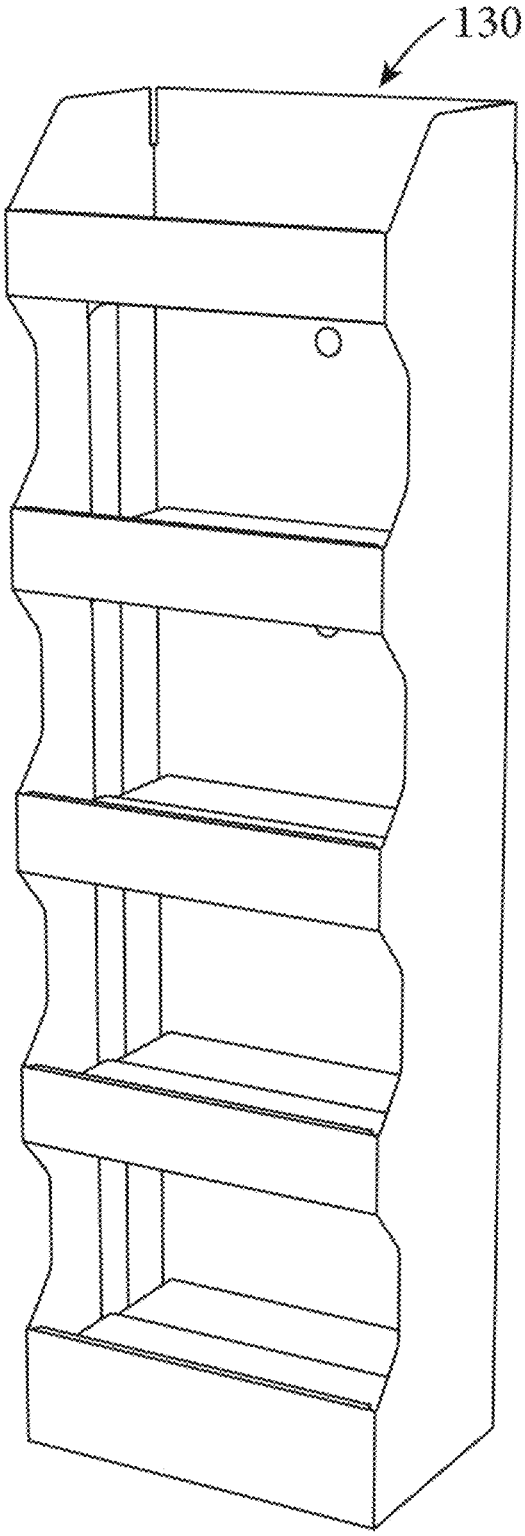
FIG. 13 is a top and right side perspective view of the embodiment of the display shelving stand of the present invention having a plurality of shelves.
Figure 14:
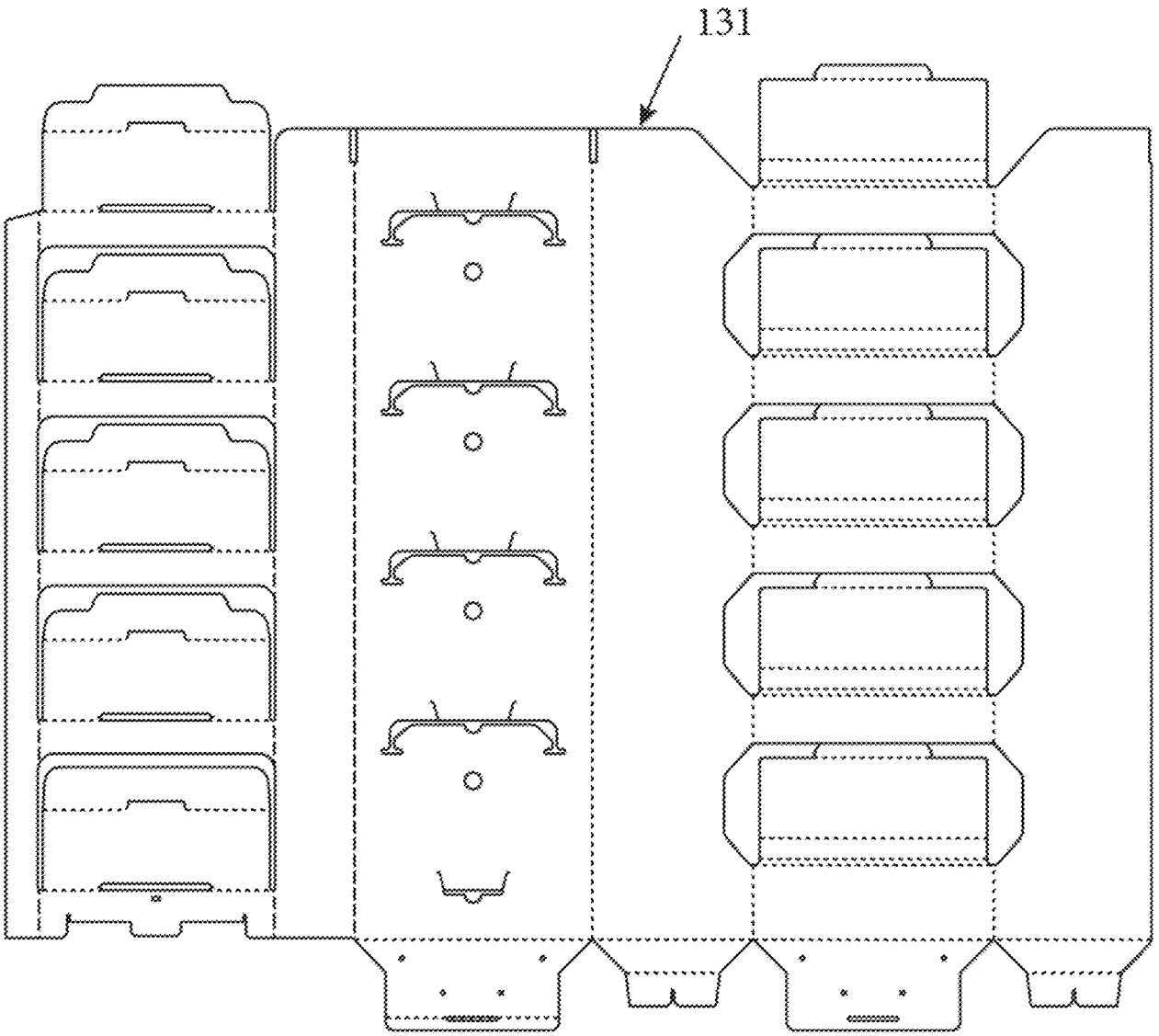
FIG. 14 is the plan elevation view of the design figure for forming the multi-shelves embodiment of the display stand of the present invention shown in FIG. 13.

A multi-shelves display stand 130 as shown in FIG. 13 according to the present invention can be fabricated from a design FIG. 131 as shown in FIG. 14 with the additional shelves having the same configuration as the shelves of the exemplary two shelves structure as described above.

Figure 15:
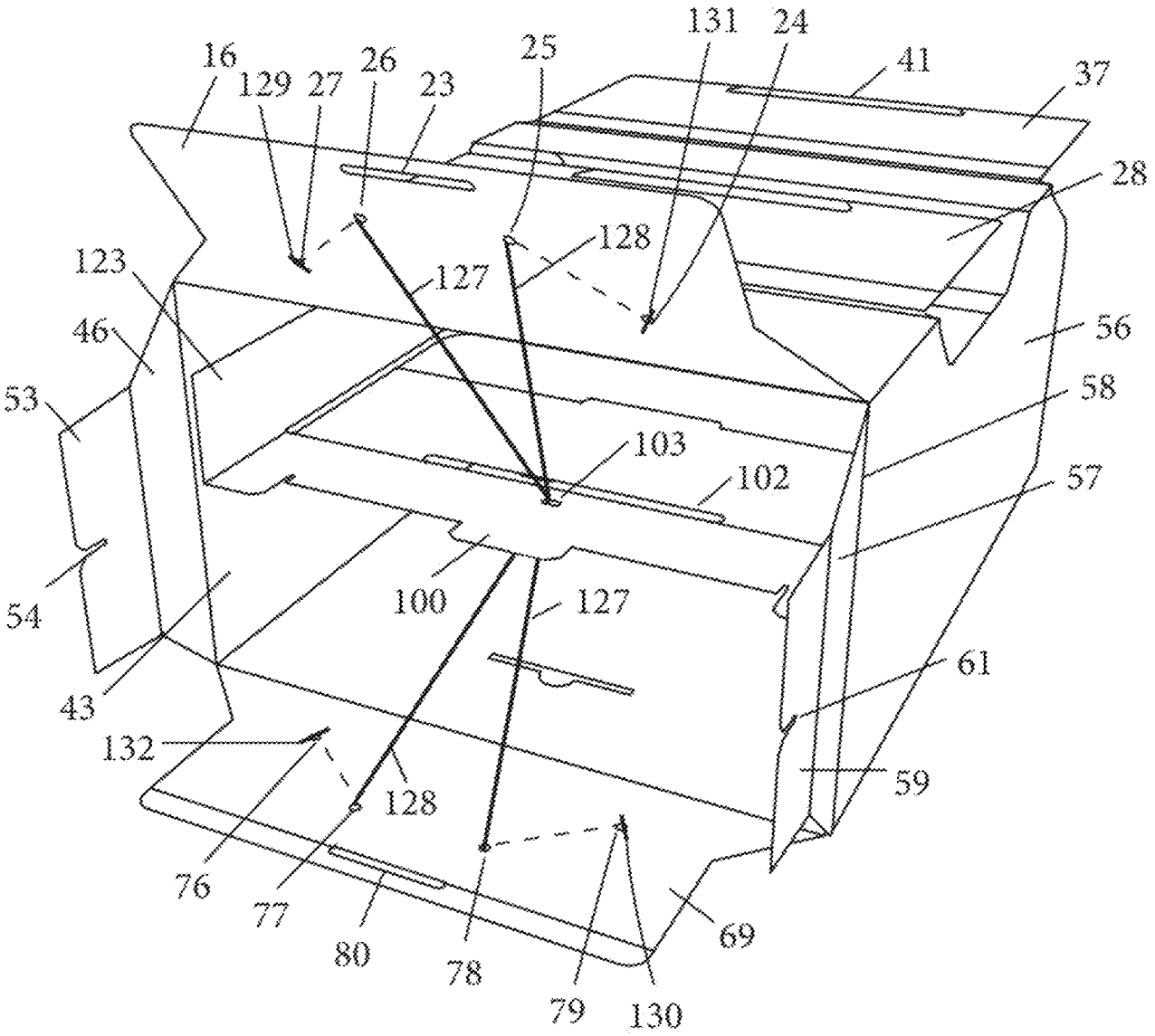
FIG. 15 is a front, bottom and right side perspective view of the display stand showing the mounting of elastic cords at the base for providing self-erecting function
Figure 16:
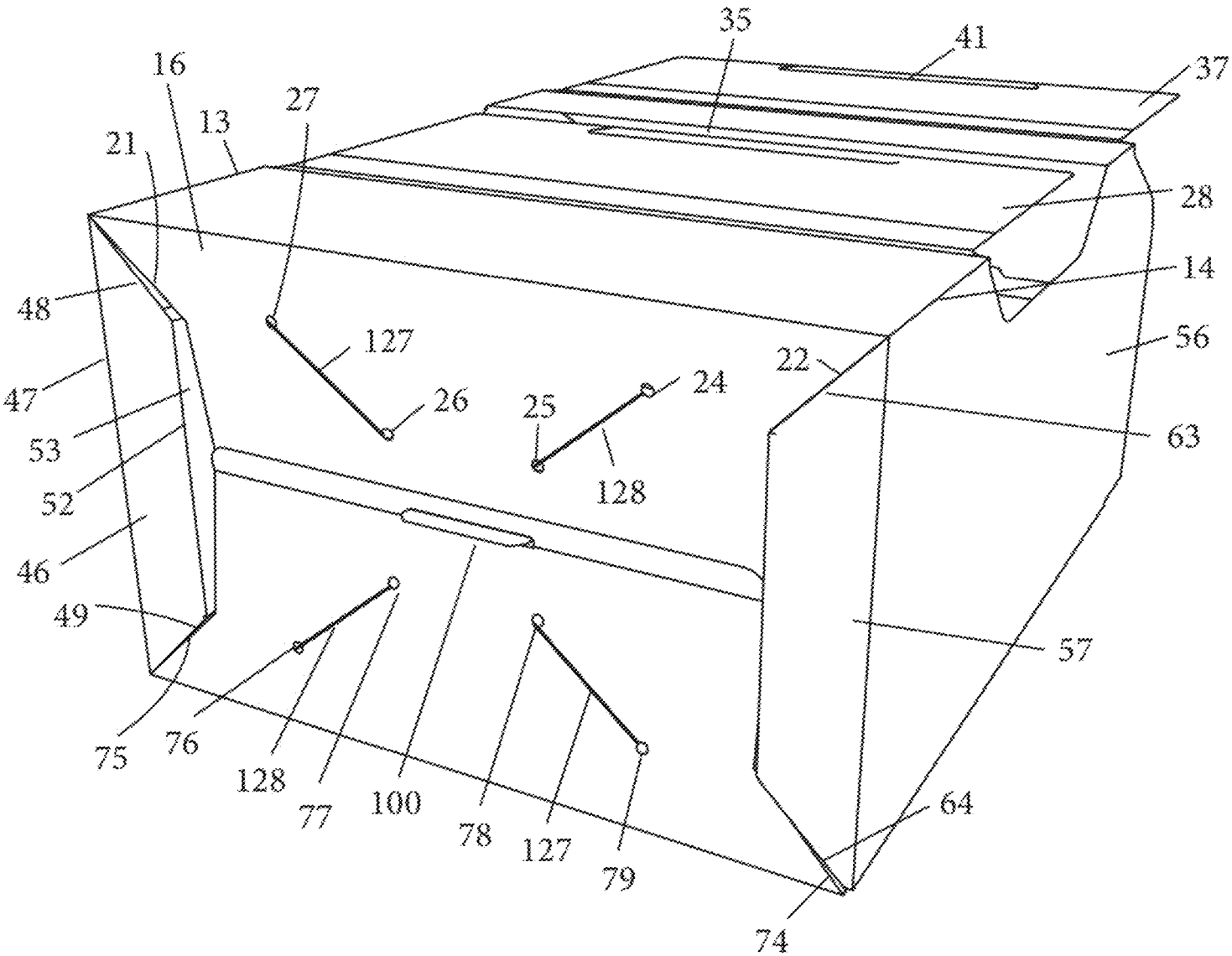
FIG. 16 is a front, bottom and right side perspective view showing the display stand base maintained fully closed by the elastic cords.

The base of the display stand may be provided with one or two elastic cords mounted between the bottom foldable panels 16 and 69 with the elastic cords threaded through the mounting opening 103 located just above the mounting tab 100 of the reinforcing panel 94. An exemplary embodiment of provision of two elastic cords 127 and 128 is shown in FIGS. 15 and 16. The elastic cord 127 is mounted between mounting opening 26 of the bottom panel 16 and the mounting opening 78 of the bottom panel 69. A retaining pin 129 is secured at the upper end of the elastic cord 127 and threaded through mounting opening 27 to retain the upper end of the elastic cord 127 is removably mounted to the bottom panel 16. The second elastic cord 128 is mounted between mounting opening 25 of the bottom panel 16 and mounting opening 77 of the bottom panel 69. A retaining pin 128 is provided at the upper free end of the elastic cord 125 which is threaded and secured to the mounting opening 24 in the bottom panel 16 to removably mounted to the bottom panel 16. A retaining pin 132 is provided at the lower end of the elastic cord 128, which is threaded through and secured to the mounting opening 76 of the bottom panel 69 to removably mounted to the bottom panel 69. The elastic cords 127 and 128 are in stressed tension when the housing assembly is in the collapsed condition with the bottom panels 16 and 65 in the opened position so that the housing assembly may be deployed to the erected condition by simply shaking the housing assembly such that the elastic cords in stressed tension will pull the bottom panels 16 and 69 to cover over the bottom of the assembly with the mounting slots 23 of the bottom panel 16 and the mounting slot 80 of the bottom panel 79 engaging with the mounting tab 100 of the reinforcing panel 94 so as to secure their mounting position over the bottom of the erected housing assembly. The trapezoidal panels 46 and 57 may then be folded to cover the remaining trapezoidal openings of the housing assembly as described above to provide the water-resistant base covering for the display shelving stand.

What is claimed is:

1. A merchandise display shelving stand constructed of a single design figure formed on a single sheet of cardboard blank, comprising:

a front panel, a rear panel, a right side panel, and a left side panel;

a connecting panel extending sideway from a vertical side edge of said rear panel;

a reinforcing panel connecting to a second vertical side edge of said connecting panel and extending vertically and mutually parallel to and spaced from said front panel and said rear panel;

an attachment panel formed at a vertical free edge of said reinforcing panel, and said attachment panel being secured to said right side panel;

said reinforcing panel having a plurality of foldable panels foldable rearwards towards said rear panel and each one of said foldable panels having a mounting tab formed at a rear edge therein, said mounting tab of said foldable panels being engageable with mounting slots formed in said rear panel for forming a plurality of horizontal rear shelves extending between said reinforcing panel and said rear panel;

said front panel also having a plurality of foldable panels foldable rearwards towards said reinforcing panel and having a mounting tab formed at a rear edge therein, and said mounting tab at the rear edge of said foldable panels of said front panel being engageable with a mounting slot at a rear edge of said horizontal rear shelves for forming a plurality of horizontal front shelves extending between said front panel and said reinforcing panel and extending aligned with said horizontal rear shelves.

2. The merchandise display shelving stand according to claim 1 wherein said reinforcing panel has a bottom mounting tab extending downward from a center portion of a bottom edge therein, and said bottom mounting tab having a bottom edge located in a raised position located above bottom edges of said front panel, rear panel, right side panel and left side panel, of said stand, said front panel having a lower extension panel with a horizontal mounting slot formed adjacent to a middle lower free edge portion therein, said lower extension panel of said front panel being foldable relative to said front panel towards said reinforcing panel to engage with said mounting slot at the bottom edge of said reinforcing panel for securing said lower extension panel to said reinforcing panel to cover over a front portion of a bottom opening of said stand, said rear panel also having a lower extension panel having another horizontal mounting slot formed adjacent to a middle lower free edge therein, said lower extension panel of said rear panel being foldable relative to said rear panel towards said reinforcing panel to engage said another mounting slot with said mounting tab at the bottom edge of said reinforcing panel for securing said lower extension panel of said rear panel to said reinforcing panel for covering over a rear portion of said bottom opening of said stand.

3. The merchandise display shelving stand according to claim 2 wherein said left side panel has a bottom extension panel foldable relative to said left side panel toward said mounting tab at the bottom of said reinforcing panel, said bottom extension panel of said left side panel having a foldable tab at a free end and a mounting slot formed in said foldable tab, said foldable tab being foldable inward of said bottom of said stand and to engage said mounting slot of said foldable tab with the bottom edge of said reinforcing panel to secure said bottom extension panel of said left panel to cover over a left side opening of the bottom of said stand, and said right side panel having another bottom extension panel foldable relative to said right side panel toward said mounting tab at the bottom of said reinforcing panel, said bottom extensions panel of said right side panel having a foldable tab with a mounting slot formed therein and said bottom extension panel of said right side panel being foldable inward of said stand and to engage said mounting slot with the bottom edge of said reinforcing panel for covering over a remaining bottom opening at the bottom of said stand.

4. The merchandise display shelving stand according to claim 3 wherein said bottom mounting tab of said reinforcing panel maintains said extension panels of said front panel, said rear panel, said left side panel, and said right side panel to slope upward toward center of said stand to provide a raised and closed water resistance base.

5. The merchandise display shelving stand according to claim 4 wherein said foldable panels of said front panel include two mutually parallel horizontal foldable lines foldable to form an upstanding front guard at front of said lower front display shelf and said horizontal front display shelves.

6. The merchandise display shelving stand according to claim 5 including at least one elastic cord mounted between said lower extension panels of said front panel and said rear panel of said stand, said one elastic cord being in stretched tension when said stand is in a collapsed state whereby said stand is self deployable from said collapsed state to an erected position under the tension of said at least one elastic cord.

7. A merchandise display shelving stand constructed of a single designed figure on a single piece of cardboard blank comprising:

a front panel, a first side panel extending from a first common vertical side edge of said front panel, a second side panel extending sideways from a second common vertical side edge located opposite to said first common side edge of said front panel, a rear panel extending sideway from a third common vertical side edge of said second side panel and located distal from said second common vertical side edge, a connecting panel extending sideway from a fourth common vertical side edge located between said rear panel and said connecting panel, a reinforcing panel extending connecting sideway from a fifth common vertical side edge located between said reinforcing panel and said rear panel, and an attachment panel extending sideway from a vertical free side edge of said reinforcing panel, said first common vertical side edge, said second common vertical side edge, said third common vertical side edge, said fourth common vertical side edge, said fifth common vertical side edge and said vertical free side edge being foldable to form the outer housing of said stand with said front panel and rear panel disposed mutually parallel and spaced from one another, and said first side panel and second said panel forming a right side panel and a left side panel of said housing, and said reinforcing panel disposed between and spaced to said front panel and said rear panel with said connecting panel abutting said left side panel, and said attachment panel abutting and attached to said right side panel, said reinforcing panel having a plurality of foldable panels foldable rearwards towards said rear panel and having a mounting tab formed at a rear edge therein, said mounting tab of said foldable panels being engageable with mounting slots formed in said rear panel for forming a plurality of horizontal rear shelves extending between said reinforcing panel and said rear panel, said front panel also having a plurality of foldable panels foldable rearwards towards said reinforcing panel and having a mounting tab formed at a rear edge therein, and said mounting tab at the rear edge of said foldable panels of said front panel being engageable with a mounting slot at a rear edge of said horizontal rear shelves for forming a plurality of horizontal front shelves extending between said front panel and said reinforcing panel and extending aligned with said horizontal rear shelves.

8. The merchandise display shelving stand according to claim 7 wherein said reinforcing panel has a bottom mounting tab extending downwardly from a center portion of a bottom edge therein, and said bottom mounting tab having a bottom edge located at a higher position above bottom edges of said front panel, right side panel, left side panel, and rear panel, a first lower foldable panel extending downward from the bottom edge of said front panel, a first horizontal mounting slot formed adjacent to a lower free edge of said first lower foldable panel, a second lower foldable panel extending downward from the bottom edge of said rear panel, a second horizontal mounting slot formed adjacent to a lower free edge of said second lower foldable panel, said first lowser foldable panel and said second lower foldable panel being foldable toward center of said housing of said stand to engage said first horizontal mounting slot and said second horizontal mounting slot with said bottom mounting tab of said reinforcing panel for securing said first lower foldable panel and said second lower foldable panel to said reinforcing panel, a third lower foldable panel extending downward from the bottom edge of said attachment panel, a fourth lower foldable panel extending downward from the bottom edge of said connecting panel, said third lower foldable panel and said fourth lower foldable panel being foldable towards center of said housing to cover over the bottom of said housing of the stand.

9. The merchandise display shelving stand according to claim 8 including a first elastic cord and a second elastic cord mounted between said first lower foldable panel and said second lower foldable panel, said first elastic cord and said second elastic cord being in stretched tension when said stand is in the collapsed condition whereby said stand in the collapsed condition is self deployable to an erected condition by a shaking action.

* * * * *